US006197726B1

(12) United States Patent
Adkins et al.

(10) Patent No.: US 6,197,726 B1
(45) Date of Patent: Mar. 6, 2001

(54) CARDS

(75) Inventors: Kelvin P Adkins; Richard A Hann; Gary J Jenno, all of Essex (GB)

(73) Assignee: Imperial Chemical Industries PLC, London (GB)

( * ) Notice: Subject to any disclaimer, the term of this patent is extended or adjusted under 35 U.S.C. 154(b) by 0 days.

(21) Appl. No.: 09/311,299

(22) Filed: May 14, 1999

Related U.S. Application Data

(63) Continuation-in-part of application No. 08/836,366, filed on May 13, 1997, now abandoned.

(30) Foreign Application Priority Data

Nov. 16, 1994 (GB) ..... 9423080

(51) Int. Cl.[7] ..... B41M 5/035; B41M 5/38

(52) U.S. Cl. ..... 503/227; 156/235; 427/152; 428/195; 428/480; 428/500; 428/913; 428/914

(58) Field of Search ..... 8/471; 428/195, 428/480, 500, 913, 914; 427/152; 503/227; 156/235

(56) References Cited

FOREIGN PATENT DOCUMENTS 62-23779 * 1/1987 (JP) .

* cited by examiner

*Primary Examiner*—Bruce H. Hess
(74) *Attorney, Agent, or Firm*—Pillsbury Winthrop, LLP

(57) ABSTRACT

Secure cards consisting essentially of a card base having an overlying thermally transferred topcoat, with a thermal transfer image in a dye-receptive surface of the card base and the topcoat typically of a polymethyl methacrylate composition, frequently show severe image fading after relative short periods of time when kept and carried in normal PVC pouches. To improve protection against such fading, the present topcoat comprises at least one barrier layer which is formed of a polymer composition having a Tg>70° C., and which is resistant to the formation of microscopic cracks in the topcoat under tensile bending that is insufficient to cause macroscopic permanent deformation.

25 Claims, No Drawings

CARDS

CROSS-REFERENCE TO RELATED APPLICATION

This application is a continuation-in-part of Ser. No. 08/836,366, filed May 13, 1997 now abandoned, the entire contents of which are incorporated herein by reference.

The invention relates to secure cards having images formed by thermal transfer printing on at least one side, and especially to thermally transferable protective topcoats for securing such images.

Thermal transfer printing is a process in which one or more thermally transferable dyes are caused to transfer from selected areas of a dyesheet to a receiver by thermal stimuli, thereby to form an image. Using a dyesheet comprising a thin substrate supporting a dyecoat containing one or more uniformly spread dyes, printing is effected by heating selected discrete areas of the dyesheet while the dyecoat is pressed against a dye-receptive surface of a receiver sheet, thereby causing dye to transfer to corresponding areas of the receiver. The shape of the image transferred is determined by the number and locations of the discrete areas which are subjected to heating. Full colour prints can be produced by printing with different coloured dyecoats sequentially in like manner, and the different coloured dyecoats are usually provided as discrete uniform panels arranged in a repeated sequence along a ribbon-shaped dyesheet.

High resolution photograph-like prints can be produced by thermal transfer printing using appropriate printing equipment, such as a programmable thermal print head or laser printer, controlled by electronic signals derived from a video, computer, electronic still camera, or similar signal generating apparatus. A typical thermal print head has a row of tiny selectively energizable heaters, spaced to print six or more pixels per millimetre, often with two heaters per pixel. Laser printers require absorbers to convert the laser radiation to heat usually in or under the dyecoat and similarly produce the print by transferring dyes to the receiver pixel by pixel.

The transfer mechanism is believed to depend very much on the conditions under which printing is carried out. Thus for example, when using a thermal head, the dyesheet and receiver are pressed together between the head and a platen roller, giving conditions favouring diffusion of the dyes from the dyesheet directly into the receiver, virtually precluding any sublimation. Where a small gap is provided between the dyesheet and receiver, as favoured in some laser driven printers for example, the transfer mechanism appears to be exclusively sublimation. However, in both cases the dyes are mobile molecules which can diffuse into and out of the receiver when warmed, or in the presence of various lyophilic liquids. In particular, grease from a finger holding a print can lead to migration of the dye to the surface, making the print seem dirty or causing smearing of the dyes, and plasticisers in plastic pouches can cause havoc with unprotected thermal transfer images. Particularly bad in this respect is dioctylphthalate, commonly used as a plasticiser in polyvinyl chloride.

For many years various protective covers have been proposed to protect thermal transfer prints against abrasion, loss of dyes by migration to the surface, and protection against UV-induced fading, for example. Very thin covers are generally preferred, typically 4 $\mu$m, which are difficult to handle without some form of support, and in the past it has been proposed first to prepare a donor sheet comprising a temporary carrier base sheet having a surface coated with a layer of transparent thermally transferable cover material, then thermally transferring the coating onto the printed receiver and removing the carrier, thereby leaving the transferred material to form a topcoat. The transfer can be effected simultaneously over the whole print, and the carrier is then removed after the transfer is complete. Alternatively, transfer may be progressive, e.g. using heated rollers or a thermal head to transfer the topcoat line by line, and it is then generally more convenient to remove the carrier progressively as it emerges from the rolls or thermal head.

It has been recognized that polymeric compositions having higher Tg values generally provide better protective coatings, but higher Tg values can lose some of the advantages of the lower Tg materials. Thus for example, good barrier materials of high Tg are not always good adhesives, and to overcome this problem, complex coatings consisting of a plurality of layers of differing functions have previously been proposed. Thus for example, multilayer polymeric coatings comprising a layer of barrier material, laminated to a layer of more adhesive material on one side for providing better adhesion to the receiver, and on the other a layer of a less adhesive material to assist in its release from the carrier, has been described in U.S. Pat. No. 4,977,136.

Because a thermal transfer image corresponds to the electronic signal fed to the thermal head, laser printer or other thermal transfer driving means, each image can be readily customized as required, and this has been made use of in producing wallet size cards with personalized images. These include, for example, credit cards, driving licenses and identification cards, all of which can have images incorporating electronic photographs, signatures and/or personal data to provide a card unique to the user. Such cards are frequently carried in plastic pouches, but plasticisers in the pouches are a particular problem because they are generally good solvents for thermal transfer dyes. A heavily plasticised PVC pouch, for example, can extract virtually all the colour from an unprotected image, and it has become the custom to protect such images with a thermally transferred polymer topcoat, typically of a polymethyl methacrylate based formulation, usually containing a small loading of filler.

The topcoat makes the card more secure by giving the image some degree of protection against abrasion and attack by plasticisers, and cards having such protective topcoats are referred to herein as secure cards, to distinguish them from cards having no topcoat.

However, presently used topcoats only provide a degree of protection. We have seen many examples of cards showing severe fading of the image with use, particularly in the more heavily printed areas. After microscopic examination of the failing cards, we believe we have found a cause for such failure, and provide herein a means for improving the useful lifespan of protected cards. Thus we found that when the above known cards are flexed, e.g. by subjecting them to unconstrained hand bending without permanent deformation, microscopic cracks formed in the topcoat over both the heavily printed areas and lightly primed areas.

According to one aspect of the invention, a method for manufacturing secure cards, each consisting essentially of a card base and a topcoat, comprises forming a thermal transfer image in a dye-receptive surface of the card base, and thermally transferring the topcoat onto the image-containing surface; wherein to improve protection against plasticiser degradation of the thermal transfer image, the topcoat comprises at least one barrier layer which is formed of a polymer composition having a Tg>70° C., and which is resistant to the formation of microscopic cracks in the topcoat under tensile bending that is insufficient to cause macroscopic permanent deformation.

A preferred method is one wherein the level of tensile bending is that achieved by supporting the ends of the secure card, flexing the card to displace by 2 cm the portion the card equidistant from its supported ends, and repeating to complete 100 such displacements; and wherein the microscopic cracks are of a size to be visible when viewed at a magnification of 400×.

In practice, this may be achieved by preparing a plurality of sample secure cards of which each is topcoated with a different barrier layer composition, flexing each card as above, selecting a thus flexed sample card for which no cracks were evident in the surface of the topcoat, and carrying out the manufacture of secure cards using a topcoat composition corresponding to that used in the selected sample. In more detail, we prefer to carry out these steps as below.

Sample Card Preparation

We prefer to prepare the sample secure cards by coating a PET film carrier with a layer of the topcoat barrier composition being tested. This is then placed in contact with a PVC card having a pre-printed thermal transfer image diffused into its contacted surface, and the foil and card passed together through a hot roller laminator unit. The PET carrier is then peeled from the card leaving the barrier coating adhered as a topcoat overlying the image. An alternative way to prepare the sample secure cards is to pass the foil and card through a printer, the thermal heads then providing the heat for transferring the topcoat barrier composition, but for this, the foil requires a heat resistant backcoat to protect the thermoplastic PET carrier from the high temperatures generated by the thermal head.

Sample Card Flexing

Flexing of the cards can be carried out rigorously by mounting the short edges of the sample cards in an ISO 7816-1:1987 (E) test rig, and flexing the card by activating the rig. The ISO 7816-1:1987 (E) test method is designed to examine for macroscopic failure in cards after 1,000 bandings, but does also provide an appropriate standard rig for evaluating microscopic crack resistance in the present context when the cards are flexed for the smaller number of cycles detailed above. In this standard test, the card is held by its ends between two jaws and one of the jaws is moved to bend the card repeatedly at a rate of 30 headings per minute. For its macro-failure testing, the test also prescribes that the card be held along its sides (as provided by its longer edges) and similarly bent repeatedly but with a deflection of only 1 cm. We have on occasions experimented with the flexing regimes by adding this further stressing, but found it to be unnecessary for the present purposes. In the various cases tested, we found generally that those samples which passed the test would survive further flexing in either direction, but those that failed the test would crack after a very small amount of flexing, with the number of cracks increasing with further flexing. While it is true that the more cracks there are, the more easily they can be seen, we found no difficulty in seeing the cracks when these were present after the limited number of bendings specified above.

However, because of the manner in which such flexing tests are generally uncritical in how the samples are stressed, we have found that consistent data can be obtained very simply by carrying out essentially the same test manually, as follows. Each of the sample secure cards produced as above, is supported in turn by its two short ends between the fingers and thumb of one hand, and the middle of the card gently raised and lowered by the other hand. The displacement at the middle is similarly about 2 cm from its undisplaced position, and the middle is displaced 50 times in each direction thus bending the card 100 times as before. Flexing the cards in both directions provides compressive as well as tensile bending. Both appear to contribute to the formation of microscopic cracks, but tests to evaluate their relative contributions have indicated that the tensile bending causes more damage than compressive bending.

Sample Card Evaluation

Irrespective of the method used to provide the flexing, we examine each flexed topcoat sample at 400× magnification using Nomarski differential interference contrast to show up surface features. Those which have visible cracks fail the test, whilst those without cracks visible at the 400× magnification, pass. We have found consistently that secure cards with a well adhered topcoat of a composition giving a pass in the above test, have provided better protection against pouch plasticisers than the previously used polymethyl methacrylate compositions.

The sheet base of the card can be a homogeneous sheet of a dye receptive polymer composition. Typical of such sheets is polyvinylchloride sheet loaded with a white filler to show off the coloured image formed of thermally transferred dyes diffused into it. Thus in this case, the material of the dye-receptive surface extends throughout the sheet base. More typical are laminates of white filled polyvinylchloride sandwiched between clear layers of vinylchloride/vinyl acetate copolymer, which are currently commercially available for the manufacture of secure cards by other methods. This copolymer is more receptive than polyvinylchloride to most thermal transfer dyes, and such laminates are preferred materials for use as the sheet bases in the secure cards of the present invention.

According to a further aspect of the invention, we provide a transfer foil comprising a carrier sheet and a coating layer of a thermally transferable barrier composition for transfer onto a thermal transfer image formed in a receiver surface, thereby to form a topcoat for providing protection against plasticiser degradation of the image, wherein the barrier composition has a Tg>70° C., and comprises a polymer resistant to the formation of microscopic cracks under tensile bending that is insufficient to cause macroscopic permanent deformation.

A preferred barrier composition is one formulated to minimize stress concentration by the use of unsuitable fillers. Previously known topcoats generally have a light loading of filler particles which are large compared to the thickness of the topcoat polymer, e. g. being about 10 $\mu$m and irregular in shape, they stand proud of a 4 $\mu$m polymer matrix to improve abrasion resistance and may also have a non-blocking effect to assist mechanical handling. However, microscopic observation of such topcoats after use, reveals cracks radiating from such fillers, and we prefer to use a topcoat compositions wherein the barrier layer composition is free from filler particles whose smallest diameter is greater than the thickness of the barrier layer.

The topcoat preferably consists of a single layer which is formed of the barrier layer composition, but alternatively can be a composite of two or more layers, this being especially beneficial when using barrier layers of a particularly high Tg. For example, the high Tg barrier polymer of the invention may also have an associated layer of lower Tg polymer which is located on its outer surface such that when transferred onto the image-containing surface of a card, the layer of low Tg polymer lies between the barrier layer and the card in order to improve the adhesion between them.

We have found that polymethyl methacrylate homopolymers, such as are presently used for topcoat foils, tend to crack when subjected to the tensile stresses described above; and this, we believe, is the reason that conventional secure cards having a thermal transfer image and kept in PVC pouches, tend to loose the quality of the image with the passage of time as the dye becomes leached out by the pouch plasticiser through cracks formed by flexing of the card during normal handling in use. Similarly, we have found that copolymers of methacrylate esters with various comonomers will readily form cracks, and suffer from the same fate. However, the addition of an acrylate ester to the methylmethcrylate as a co-monomer, even as a minor amount, provides a copolyer having resistance to cracking when flexed, and hence giving superior resistance to leaching of the dyes forming the image, by pouch plasticizer. The amount of acrylate ester that can be added as co-monomer is limited by the need to keep the Tg maintained above 70° C.

Moreover, we have found that this beneficial effect occurs when acrylate esters are copolymerised with other commoners whose homopolymers we have found to crack readily when flexed. For example. parahydroxystyrene/butyl acrylate copolymer provides a much stronger barrier than parahydroxystyrene/methylmethacrylate copolymer, or parahydroxystyrene/styrene copolymer. A preferred transfer foil is thus one wherein the polymer of the barrier composition is a copolymer of an acrylate ester. Particularly preferred are copolymers of methyl methacrylate and ethyl acrylate, and copolymers of parahydroxystyrene and butyl acrylate.

Another class of compounds that we have found to be particularly effective are the polyesters, especially those which contain a dicarboxylic acid residue.

Suitable dicarboxylic acids for formation of the polyester include phthalic acid, terephthalic acid, isophthalic acid, adipic acid, oxalic acid, maleic acid, sebacic acid and the like, with terephthalic and isophthalic acids being particularly preferred. The preferred polyesters may be formed from one type of dicarboxylic acid or from combinations of two or more dicarboxylic acids. For example, a polyester may be formed from a composition comprising a combination of terephthalic acid and isophthalic acid.

It is particularly preferred to use polyesters containing a propylene glycol residue. Propylene glycol preferably constitutes the main or sole diol component of the polyester, being present in an amount of at least 50 molecular %, preferably at least 70 molecular %, of the diol component, with the balance, if any, suitably being constituted by other glycols, conveniently ethylene glycol. Suitable preferred commercially available polyester of this type include Vylon GK-640 and Vylon ST5020 (Vylon is a TradeMark) from Toyobo. Analysis indicates that both of these materials contgain propylene glycol as the principal diol component, present at about 70 molecular %, with the residue of the diol component being ethylene glycol. The acid component appears to be terephthalic acid with a small amount of isophthalic acid. The polyesters can thus be represented as follows:

$$[(O—CO.C_6H_4.CO—O—O—CH_2CH_2—)_{0.3}(O—CO.C_6H_4.CO—O—CH_2CH(CH_3)—)_{0.7}]$$

Of the polyesters tested, Vylon GK-640 and Vylon ST5020 gave particularly good resistance to cracking, and there was no visible dye migration seen, even after prolonged thermal accelerated aging (as described in the Examples hereinafter).

The barrier layer of the transfer foil can contain some particulate fillers, but for the reasons discussed above, we prefer that it be free from filler particles whose smallest diameter is greater than the thickness of the barrier layer. Preferably the transfer foil is exclusive of, meaning does not comprise, inks (including dyes).

The transfer foil comprises a carrier sheet and coating layer of thermally transferable topcoat barrier composition, and this carrier sheet can be any sheet or coated sheet able to withstand the transfer temperatures. Paper can be used, but the thicker the sheet, the more transfer energy is required, and we prefer to use polymer films, such as PET film, typically less than 30 $\mu$m thick according to the manner in which the barrier composition is to be transferred. In connection with the preparation of the test samples, we discussed two methods for transferring the barrier composition. For these we prefer to use a carrier sheet of about 12 $\mu$m when using a hot roller laminator unit, but a heat-resistant back-coated film of 4–6 $\mu$m thickness is preferred when using a thermal head.

To assist in release of the cover material from a thermoplastic carrier sheet, we prefer that the latter be primed with a cross-linked resin, to prevent fusion between the carrier and the transferring cover material. Such primes, applied effectively in known manner, remain on the carrier as it is stripped off. Other coatings featuring one or more of the many known release agents or releasing binders, can be provided instead or in addition to the cross-linked prime, but with such materials there is a chance that at least some will transfer with the cover material. This can be undesirable in a number of applications. especially those requiring lamination of the print to a security cover sheet; in the passports, driving licenses, medical cards and security passes referred to above, for example. In general, therefore, we prefer to coat the transferable cover material directly onto the primed surface of the carrier base sheet of the transfer foil.

The transfer foil can be separate from the dyesheet used to prepare the image, although it is often convenient to have this packaged in a form which enables it to be used in the same apparatus as that which prints the image. To have the dyesheet ribbon and the present transfer foil as separate entities, whether used in the same apparatus or not, enables a first printed card to be covered with topcoat while a further image is being formed on a second card, thereby saving time.

However, a preferred transfer foil is one which is incorporated into a dyesheet ribbon, suitably that used to form the image, comprising a substrate supporting different coloured dyecoats provided as discrete uniform print-size panels arranged in a repeated sequence along the ribbon, the carrier sheet of the transfer foil being provided by a part of the dyesheet substrate between repeated sequences of the dyecoat panels. Thus each sequence of print-size coloured dyecoats also has a further print-size panel of the thermally transferable topcoat barrier composition.

According to a further aspect of the invention, there is provided a secure card consisting essentially of a card base having a thermal transfer image in a dye-receptive surface, and a thermally transferred topcoat overlying the image-containing surface; wherein to improve protection against plasticiser degradation of the thermal transfer image, the topcoat comprises at least one barrier layer which is formed of a polymer composition having a Tg>70° C., and which is resistant to the formation of microscopic cracks in the topcoat under tensile bending that is insufficient to cause macroscopic permanent deformation.

According to a further aspect of the invention, a method for providing improved protection against plasticiser degradation of a thermal transfer image formed in a dye-receptive surface of a card, comprises thermally transferring onto the image containing surface, a topcoat of a polymer composition having a Tg>70° C., and which is resistant to the formation of microscopic cracks in the topcoat under tensile bending which is insufficient to cause macroscopic permanent deformation.

EXAMPLE 1

Three coating compositions were prepared based on the following polymers.

| | Polymer Product name | Tg ° C. | melting temp ° C. | yield strain % |
|---|---|---|---|---|
| A | poly(bisphenol A carbonate) Makrolon 5905 (Mobay/Bayer | 162 | 220–230 | 6 |
| B | phenoxy resin UCAR PKHH (Union Carbide) | 98 | 180 | 4 |
| C | poly(methylmethacrylate) Neocryl B811 (Zeneca) | 105 | | |

The solutions were made up using the following solvents.

| | Polymer | Solids % w/w solution | Solvent |
|---|---|---|---|
| A | poly(bisphenol A carbonate) | 7.5 | 100% methylene dichloride |
| B | phenoxy resin | 15 | 99% methyl ethyl ketone, 1% water |
| C | Poly(methylmethacrylate) | 15 | 100% methyl ethyl ketone |

To prepare the transfer foils, the above solutions were hand coated by Meier bar onto pre-backcoated and subbed 6 μm PET film carriers, each to give a wet coat thickness of approx. 12 μm. In the case of solution A, two coatings were applied with oven drying between applications. The coatings were then dried in oven at 80° C. for 60 seconds.

Preparation

Samples of the above transfer foils were each placed in contact with a PVC card having a pre-printed thermal transfer image diffused into its contacted surface, and the foil and card passed together through a hot roller laminator unit. The lamination temperatures as measured by wax indicator strip at the card surface were >116° C. & <122° C. in each case. The PET carriers were then peeled from the cards leaving the polymer coatings adhered as topcoats overlying the images.

Flex Resistance Test

This was a simple manual test wherein each card in turn was supported by its two ends between the fingers and thumb of one hand, and the middle of the card gently raised and lowered by other hand. The displacement at the middle was approximately 2 cm in each direction, and the middle was displaced 100 times in each direction.

After flexing, the three topcoats were examined at 400× magnification using Nomarski differential interference contrast to show up surface features. The polymethyl methacrylate topcoat of sample C was clearly seen to have cracked and thus fail the test, whereas no cracks were seen in either of samples A (polycarbonate) or B (phenoxy resin).

Evaluation of Flex Cracking Criteria

All three topcoated cards were placed in commercial plasticized PVC pouches containing approximately 24 wt % of di-octyl phthalate plasticiser. The PVC of each pouch was held against the topcoat of the secure card lodged inside it, by weighting it with a small steel plate (approximately 25×50×3 mm) weighing about 30 g. Each card, with its pouch and weight was then placed on a flat surface in an oven maintained at 50+/−2° C. for five days, to provide thermally accelerated ageing. The PVC pouch was then removed, and the image examined by eye and optical microscope at 200× and 500× magnification using DIC and dark field illumination for evidence of dye migration and/or loss. The PVC pouch was also examined for transferred dye.

The polymethyl methacrylate topcoated sample (C) exhibited considerable dye loss. This was observed under the microscope as white dye-free regions extending from the cracks. No dye migration was detected in either of samples A (polycarbonate) or B (phenoxv resin). The PVC pouches were then replaced on samples A and B, and the cycle repeated for a further five days, but no dye migration was observed in either case.

EXAMPLE 2

A variety of other polymer compositions were examined in essentially the same manner as that described in Example 1. The results are expressed in tabular form below.

| | Tg ° C. | Visible cracks | Visible migration or loss after 10 days |
|---|---|---|---|
| polyester | | | |
| Vylon ST5020 | 79 | no | no |
| Vylon GK-640 | 79 | no | no |
| Dynapol L912 | 103 | no | no |
| Dynapol L206/1 | 66 | no | yes |
| Vylon GK880 | 84 | no | no |
| acrylic | | | |
| Elvacite 2009 | 87 | no | no |
| Elvacite 2010 | 98 | no | no |
| Elvacite 2013 | 80 | yes | yes |
| PMMA-high MW | 105 | yes | yes |
| Diakon MG 102 | 105 | yes | yes |
| competative product | | yes | yes |
| polysulphones | | | |
| Udel | 190 | no | no |
| "(over adhesive layer) | | no | no |
| polycarbonate | | | |
| Lexan 121 | 150 | no | no |
| acetal | | | |
| Vinylec E | 105 | no | no |
| Vinylec K | 105 | no | |
| S-Lec PVAA BL-3 | 95 | no | no |
| PPHS copolymer | | | |
| Lyncure CBA | >100 | no | no |
| Lyncure CST50 | >100 | yes | yes |
| Lyncure CMM | >100 | yes | yes |
| phenoxy | | | |
| phenoxy/Estane 60/40 | | no | no |
| "(over adhesive layer) | | no | no |
| chlorinated PVC | | | |
| Genclor S | 100 | yes | yes |
| Temprite 563 | 130 | yes | yes |
| polystyrene | | | |
| Polysciences 125-250 KDa | 100 | yes | |

-continued

| | Tg ° C. | Visible cracks | Visible migration or loss after 10 days |
|---|---|---|---|
| cellulosic | | | |
| CAB 551-0.2 | 101 | yes | yes |
| no topcoat | | n/a | total (@. 1 day) |

In the above table, "Vylon" is a trade name of Toyobo, "Dynapol" is a trade name of Huels AG, "Elvacite" is a trade name of ICI Acrylics, "Vinylec" is a trade name of Chisso, "Lyncure" is a trade name of Maruzen Chemical Co, "Genclor" is a trade name of ICI C&P, "Temprite" is a trade name of BE Goodrich, "CAB 551-0.2" is a trade name of Eastman, and "Udel" is a trade name of Amoco.

The results in the table illustrate the correlation between the formation of visible cracks on flex testing, and the onset of dye migration within 10 days under the conditions of thermally accelerated ageing. Those which did exhibit cracking ("yes" in the "Visible cracks" column) fail the flex test, and fall outside the criteria for the barrier materials according to the present invention. Of those that passed, Vylon GK-640, Vylon ST5020, Elvacite 2009 and Lyncure CBA, all adhere well to PVC cards, are robust to flexing, and give particularly good resistance to plasticiser induced dye migration. These materials are preferred. The two Vylon compositions are both believed to be polyesters containing propylene glycol as the principal glycol component. Elvacite 2009 is a copolymer of methyl methacrylate and ethyl acrylate, and Lyncure CBA is a copolymer of parahydroxystyrene and butyl acrylate.

What is claimed is:

1. A method for manufacturing secure cards, each comprising a card base and a topcoat, by forming a thermal transfer image in a dye-receptive surface of the card base and thermally transferring the topcoat onto the image-containing surface; wherein to improve protection against plasticiser degradation of the thermal transfer image, the topcoat comprises at least one barrier layer which is formed of a polymer composition having a Tg>70° C., and which is resistant to the formation of microscopic cracks in the topcoat under tensile bending that is insufficient to cause macroscopic permanent deformation, wherein the polymer composition comprises a copolymer of an acrylate ester or the polymer composition comprises a polyester containing a dicarboxylic acid residue, and the barrier layer constitutes the sole or outer layer of the topcoat.

2. A method as claimed in claim 1, wherein the level of tensile bending is that achieved by supporting the ends of the secure card, flexing the card to displace by 2 cm the portion of the card equidistant from its supported ends, and repeating to complete 100 such displacements; and wherein the microscopic cracks are of a size to be visible when viewed at a magnification of 400×.

3. A method as claimed in claim 1, wherein the card comprises a laminate of white filled polyvinylchloride sandwiched between clear layers of vinylchloride/vinyl acetate copolymer, at least one of which layers provides the image containing surface onto which the topcoat is transferred.

4. A method as claimed in claim 1, wherein the barrier layer composition is free from filler particles whose smallest diameter is greater than the thickness of the barrier layer.

5. A method as claimed in claim 1, wherein the topcoat consists of a single layer which is formed of the barrier layer composition.

6. A method as claimed in claim 1, wherein the polymer comprises a copolymer of methyl methacrylate and ethylacrylate.

7. A method as claimed in claim 1, wherein the polymer comprises a copolymer of parahydroxystyrene and butyl acrylate.

8. A method as claimed in claim 1, wherein the polymer comprises a polyester containing a propylene glycol residue.

9. A method as claimed in claim 8, wherein the polymer comprises a polyester of which the diol component comprises at least 50 molecular % propylene glycol.

10. A method as claimed in claim 9, wherein the diol component of the polyester comprises at least 70 molecular % propylene glycol.

11. A method as claimed in claim 9 or 10, wherein the diol component of the polyester further comprises ethylene glycol.

12. A transfer foil comprising a carrier sheet and a coating layer of a thermally transferable barrier composition for transfer onto a thermal transfer image formed in a receiver surface, thereby to form a topcoat for providing protection against plasticiser degradation of the image, wherein the coating layer comprises a barrier layer which is formed of a polymer composition having a Tg>70° C., and which is resistant to the formation of microscopic cracks under tensile bending that is insufficient to cause macroscopic permanent deformation, wherein the polymer composition comprises a copolymer of methylmethacrylate and ethylacrylate or the polymer composition comprises a polyester containing dicarboxylic acid residue.

13. A transfer foil as claimed in claim 12, wherein the polymer comprises a polyester containing a propylene glycol residue.

14. A transfer foil as claimed in claim 13, wherein the polymer comprises a polyester of which the diol component comprises at least 50 molecular % propylene glycol.

15. A transfer foil as claimed in claim 14, wherein the diol component of the polyester comprises at least 70 molecular % propylene glycol.

16. A transfer foil as claimed in claim 14 or 15, wherein the diol component of the polyester further comprises ethylene glycol.

17. A transfer foil as claimed in claim 12, which is incorporated into a dyesheet ribbon comprising a substrate supporting different coloured dyecoats provided as discrete uniform print-size panels arranged in a repeated sequence along the ribbon, the carrier sheet of the transfer foil being provided by a part of the dyesheet substrate between repeated sequences of the dyecoat panels.

18. A secure card comprising a card base having a thermal transfer image in a dye-receptive surface, and a thermally transferred topcoat overlying the image-containing surface, wherein to improve protection against plasticiser degradation of the thermal transfer image, the topcoat comprises at least one barrier layer which is formed of a polymer composition having a Tg>70° C., and which is resistant to the formation of microscopic cracks in the topcoat under tensile bending that is insufficient to cause macroscopic permanent deformation, wherein the polymer composition comprises a copolymer of an acrylate ester or the polymer composition comprises a polyester containing a dicarboxylic acid residue, and the barrier layer constitutes the sole or outer layer of the topcoat.

19. A secure card as claimed in claim 18, wherein the polymer comprises a copolymer of methyl methacrylate and ethyl acrylate.

20. A secure card as claimed in claim 18, wherein the polymer comprises a copolymer of parahydroxystyrene and butyl acrylate.

21. A secure card as claimed in claim 18, wherein the polymer comprises a polyester containing a propylene glycol residue.

22. A secure card as claimed in claim 21, wherein the polymer comprises a polyester of which the diol component comprises at least 50 molecular % propylene glycol.

23. A secure card as claimed in claim 22, wherein the diol component of the polyester comprises at least 70 molecular % propylene glycol.

24. A secure card as claimed in claim 22 or 23, wherein the diol component of the polyester further comprises ethylene glycol.

25. A method of providing improved protection against plasticiser degradation of a thermal transfer image formed in a dye-receptive surface of a card, comprising thermally transferring onto the image-containing surface, a topcoat comprising a barrier layer which is formed of a polymer composition having a Tg>70° C., and which is resistant to the formation of microscopic cracks in the topcoat under tensile bending which is insufficient to cause macroscopic permanent deformation, wherein the polymer composition comprises a copolymer of an acrylate ester or the polymer composition comprises a polyester containing a dicarboxylic acid residue, and the barrier layer constitutes the sole or outer layer of the topcoat.

* * * * *